US011087723B2

(12) United States Patent
Hackett

(10) Patent No.: US 11,087,723 B2
(45) Date of Patent: Aug. 10, 2021

(54) KEYLESS LOCKING TREMOLO SYSTEMS AND METHODS

(71) Applicant: Mark E. Hackett, Lago Vista, TX (US)

(72) Inventor: Mark E. Hackett, Lago Vista, TX (US)

( * ) Notice: Subject to any disclaimer, the term of this patent is extended or adjusted under 35 U.S.C. 154(b) by 0 days.

(21) Appl. No.: 16/728,328

(22) Filed: Dec. 27, 2019

(65) Prior Publication Data

US 2020/0143776 A1 May 7, 2020

Related U.S. Application Data

(63) Continuation of application No. 15/370,785, filed on Dec. 6, 2016, now Pat. No. 10,553,186, which is a continuation of application No. 14/979,679, filed on Dec. 28, 2015, now Pat. No. 9,542,915.

(60) Provisional application No. 62/096,970, filed on Dec. 26, 2014.

(51) Int. Cl.

| | |
|---|---|
| ***G10D 3/12*** | (2020.01) |
| ***G10D 1/08*** | (2006.01) |
| ***G10D 3/153*** | (2020.01) |

(52) U.S. Cl.
CPC ..... *G10D 3/12* (2013.01); *G10D 1/08* (2013.01); *G10D 3/153* (2020.02)

(58) Field of Classification Search
CPC ..... G10D 3/12; G10D 3/153; G10D 1/08
See application file for complete search history.

(56) References Cited

U.S. PATENT DOCUMENTS 5,373,769 A * 12/1994 Sherman ..... G10D 3/153 84/313
2015/0279341 A1* 10/2015 Maslarov ..... G10D 3/153 84/313

* cited by examiner

*Primary Examiner* — Kimberly R Lockett
(74) *Attorney, Agent, or Firm* — Fraley Patent Law, PLLC

(57) ABSTRACT

Embodiments disclosed herein describe keyless locking tremolo systems and methods for musical instruments that are configured to tune and restrain strings for a musical instrument without an external tool. Embodiments are configured to adjust the vertical positioning of a tightening post and string clamp without an external tool.

18 Claims, 16 Drawing Sheets

KEYLESS LOCKING TREMOLO SYSTEMS AND METHODS

CROSS-REFERENCE TO RELATED APPLICATIONS

This application claims a benefit of priority under 35 U.S.C. § 119 to Provisional Application No. 62/096,970 filed on Dec. 26, 2014, and is a continuation of U.S. Ser. No. 15/370,785 filed on Dec. 6, 2016, which is a continuation of U.S. Ser. No. 14/979,679, which are fully incorporated herein by reference in their entirety.

BACKGROUND INFORMATION

Field of the Disclosure

Examples of the present disclosure relate to keyless locking tremolo systems and methods for musical instruments. More specifically, embodiments relate to a string restraining system for a nut and tremolo bridge of a musical instrument that is configured to lock and unlock a string without an external tool.

Background

Conventional locking tremolo systems may include a tremolo bridge configured to anchor strings to a body of a guitar and nut of the guitar. Tremolo bridges are configured varying the tension of the strings by controlling a lever. The lever enables a player to quickly and temporarily change the tension of the strings, changing the pitch of the strings. However guitars equipped with conventional locking tremolos systems are more difficult to re-string, intonate, tune, and keep in tune than non-locking tremolo systems. In order to remove or replace a string in a conventional locking tremolo an Allen wrench is required to rotate a cap screw clamping the string restrained in the tremolo string saddle. Prior to use the replacement string must first have the ball end removed before being inserted into the string saddle. The Allen wrench is then required to rotate the cap screw again to clamp the string between the saddle and a saddle block within it to constrain the string. This requires a considerable force to be exerted in order to prevent the string from being pulled out when tension is applied. This repeated application of force can cause string saddles and saddle blocks to crack as well as damage the cap screw and the Allen wench itself. Without first locating then using the external tool, broken or worn strings cannot be removed for replacement. Additionally, on conventional lacking tremolos there are no provisions to precisely intonate the string saddles to compensate for various string gauges to allow the musical instrument to play in tune. Intonation requires first comparing an open string $12^{th}$ fret harmonic to the fretted $12^{th}$ fret note. If the fretted note is sharp or flat in pitch relative to the $12^{th}$ fret harmonic the string length must be shortened or lengthened by adjusting the saddle closer to or further away from the nut. First the tension on the string must be reduced, a screw holding the saddle in place loosened, the saddle's position altered slightly by an approximate amount and the screw retightened, the string retuned to pitch and the $12^{th}$ fret harmonic again compared to the fretted note at the $12^{th}$ fret. If the two notes are not identical the entire process must be repeated again. This tedious trial and error process can take a substantial amount of time and must be performed for each individual string.

Conventional locking nut systems include a string clamp, wherein conventional string clamp fasteners are configured to be rotated by the external tool. In one example, by rotating the string clamp socket cap screw using an. Allen wrench, the string clamp may be moved towards a locking nut base to sandwich the strings between the string clamp and a locking nut base. This force restrains movement of the strings at the locking nut preventing the strings from becoming out of tune from tremolo use. This requires great force to be applied to the string clamp, strings, and locking nut base. This same force is required to loosen the string clamps. This repeated application of force can lead to string clamp socket cap screws or tools becoming damaged preventing removal of the strings. Furthermore, once the strings are tightened via the external tool, the user can no longer change the gross tuning with the headstock tuning keys or replace the strings without the use of an external tool.

Thus, with conventional string restraining systems and locking tremolo bridges, tuning must be performed with either fine tuners or by using the external tool to first loosen the locking nut string clamps, adjust the string pitch with a headstock tuning key, and then retighten the string clamps with the external tool. This process can take a sufficient amount of time, the socket of the string clamp fastener or the tool itself may become worn out, or the user may not be able to find the external tool.

Accordingly, needs exist for more effective and efficient systems and methods for restraining strings on locking nuts and tremolo systems without an external tool.

SUMMARY

Embodiments disclosed herein describe keyless locking tremolo systems and methods for musical instruments that securely clamp the strings to a musical instrument without an external tool. Embodiments may include a first locking system positioned at the nut of the musical instrument, and a second locking system positioned at the tremolo bridge of the musical instrument.

Embodiments of the first locking system may be configured to adjust the vertical positioning of a tightening post and string clamp without an external tool. Embodiments of the second locking system may be configured to anchor the string ahead of the ball end of the string by concentrically clamping the string. Embodiments may be configured to provide the high tuning stability of double locking tremolo systems, with the ease of using non-locking tremolos. Embodiments may not require external tools to tune or replace strings, and the strings may not need to have their ball ends cut.

Embodiments of the first locking system may include a locking base and locking system.

The locking base may include a first sidewall a second sidewall, and tightening post receivers. The first sidewall may be positioned at a front end of the lock base, and the second sidewall may be positioned at a back end of the locking base. The first sidewall and the second sidewall may protrude from the locking base to form a channel between the first sidewall and the second sidewall. The first sidewall and the second sideman may also include notches, indentions, scores, etc., wherein strings of the musical instrument are configure to be positioned within the notches. The tightening post receivers may be threaded holes, fasteners, etc. positioned on the channel through the locking base, wherein the tightening post receivers may extend through the locking base.

The locking system may include string clamps, tightening posts, and levers. The string clamps may be configured to be inserted into the channel on the locking base between the first sidewall and the second sidewall. The string clamps may have a clamping surface that is configured to anchor the strings in place between the clamping surface and the channel on the locking base. The string clamps may also include recessed holes and springs extending through a body of the string clamps, where the holes are configured to align with the tightening post receivers.

The tightening posts may include a threaded portion, a lever engagement mechanism, a smooth shaft, and a lever. The threaded portion may be configured to be inserted through the hole in a string clamp, and the tightening post receivers within the locking base. The lever engagement mechanism may be configured to allow the lever to engage and disengage with the tightening post to tighten or loosen the tightening post yet remain coupled. The smooth shaft may be configured to allow the lever to be rotated without turning the tightening post when the lever is disengage from the lever engagement mechanism. The lever may be configured to disengage and engage with the tightening post to tighten or loosen the tightening post. The lever may be configured to apply sufficient torque by hand to tighten or loosen the tightening post without needing an external tool. Embodiments may include three levers, wherein each lever is associated with two strings. The levers may be spring loaded, wherein each of the levers may be independently lifted and rotated.

In embodiments, responsive to the lever being engaged with the lever engagement mechanism and rotated in a first direction, the threaded portion of the tightening post may tighten the string clamp into the locking base to anchor one or more strings between the base and the string clamp. Responsive to the lever being engaged with the lever engagement mechanism and rotated in a second direction, the string clamp may be loosened or moved away from the base.

In embodiments, responsive to vertically moving the lever, the lever may be disengaged with the lever engagement mechanism, and be rotated in the first or second direction without tightening or loosening the string clamp. This action may allow for reciprocal movement within the tight confines of adjacent string clamps and tightening posts in a musical instrument. In embodiments, the lever may remain coupled to the tightening post in the engaged and disengaged positions so that the lever is readily accessible to a user.

The second locking system may include a circumferential clamp with a collet and a closer. The collet and closer may be configured to anchor the string ahead of a ball end of the string. By concentrically clamping the circumference of the string ahead of the ball end, any issue of slack between the ball end and a wire loop may be negated. In implementations, when the string is tensioned up to pitch, the collet may be configured to prevent the ball end of the string from pulling through the circumferential clamp. Responsive to a tremolo arm being depressed or raised to allow the string tension to decrease or increase, the force of the closer on the collet may be sufficient to prevent the string from reversing or being pulled out of the circumferential clamp.

Embodiments may also include an internally threaded knurled cylinder that concentrically surrounds the closer. The threaded knurled cylinder may be configured to adjust the intonation of the musical instrument. The threaded knurled cylinder may be configured to be positioned against a surface of a tremolo base plate holding a loosened string saddle in place while adjusting the saddle for correct intonation.

Embodiments may include a string ramp that is configured to allow a string to more easily pass through and over a conventional saddle. The string ramp may have a lower break angle over the saddle, wherein the string ramp is less than a ninety degree angle. This may reduce string breakage.

In embodiments the combination of a locking tremolo system with a keyless locking nut and a keyless locking tremolo may provide the high tuning stability of a double locking tremolo system with the ease of using a non-locking tremolo system. In embodiments no tools are required to tune or replace strings, no expensive or hard to find special strings are required, any industry standard strings may be used, and there is no need to first cut off the ball end of the string. The keyless locking system may serve as a built in string extractor that can safely and easily remove the strings eliminating finger injury trying to remove small broken off pieces of strings from the saddles in existing tremolos.

Embodiments may also provide greater overall contact area for the strings for improved tone. There may be less string breaking due to the shallower angle of the string entering the saddle. The keyless locking systems may work on both left and right handed instruments.

These, and other, aspects of the apparatus will be better appreciated and understood when considered in conjunction with the following description and the accompanying drawings. The following description, while indicating various embodiments of the apparatus and numerous spec details thereof, is given by way of illustration and not of limitation. Many substitutions, modifications, additions or rearrangements may be made within the scope of the apparatus, and the apparatus includes all such substitutions, modifications, additions or rearrangements.

BRIEF DESCRIPTION OF THE DRAWINGS

Non-limiting and non-exhaustive embodiments of the present invention are described with, reference to the following figures, wherein like reference numerals refer to like parts throughout the various views unless otherwise specified.

Figure 1:
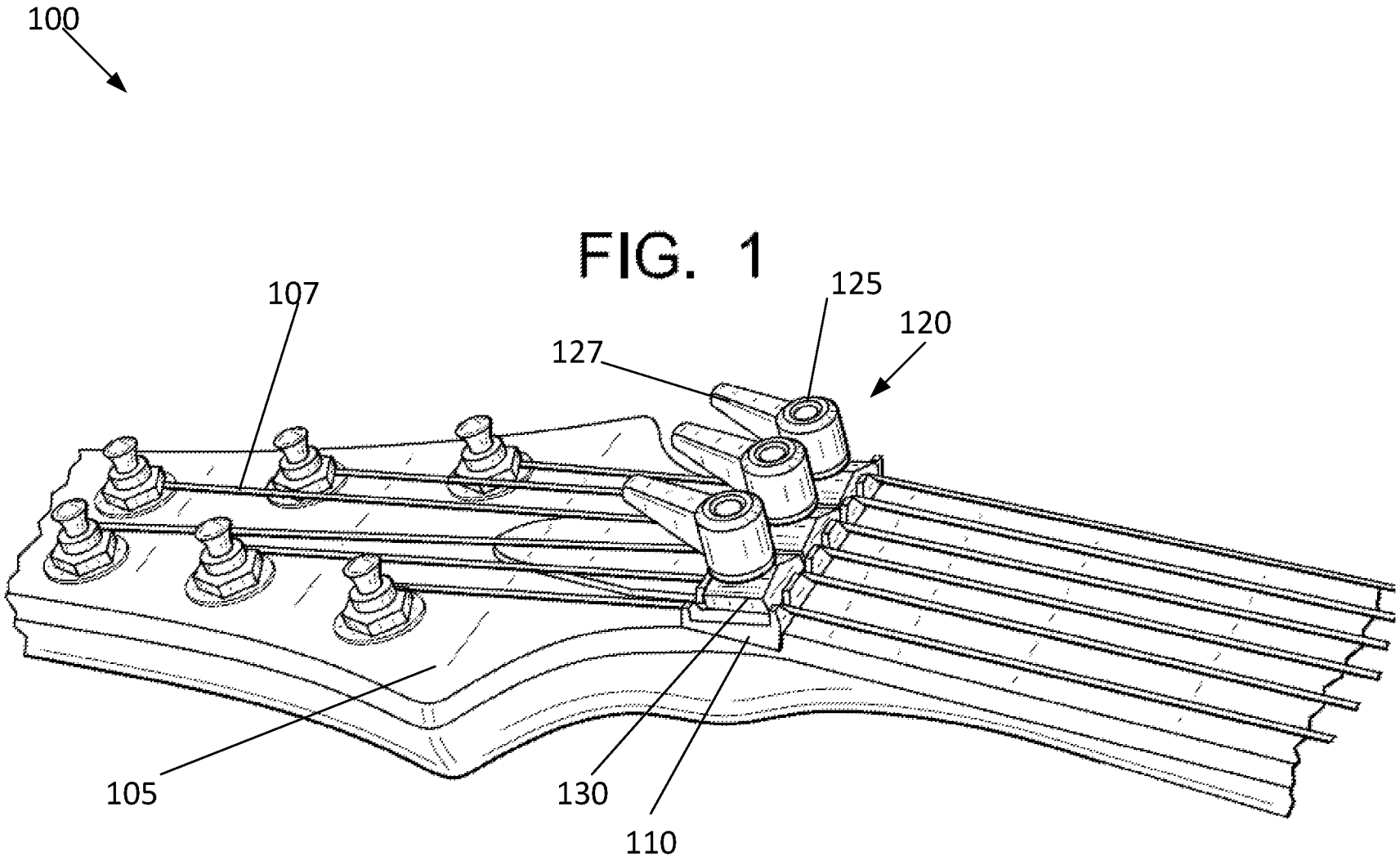
FIG. 1 depicts a first keyless locking system positioned proximate at the headstock end of a fingerboard as a nut of a stringed musical instrument, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Turning now to FIG. 1, FIG. 1 depicts a first keyless locking system 100 positioned as a nut of stringed musical instrument 105, according to an embodiment. Locking system 100 may be configured to separate the strings 107 of musical instrument 105 at even intervals, and to anchor strings 107 in place to prevent movement of strings 107. First locking system 100 may include a locking base 110 and locking system 120.

Locking base 110 may be configured to be positioned to replace the non-locking nut of musical instrument 100. Locking base 110 may be configured to extend across a neck of musical instrument 105. Locking base 110 may be configured to receive locking system 120, wherein strings 107 are anchored between locking base 110 and locking system 120.

Locking system 120 may include a plurality of levers 125. Each of the plurality of levers 125 may be associated with two strings 107 and a string clamp 130. Levers 125 may be configured to rotate in a first direction to tighten a string clamp 130 to anchor the corresponding strings 107 via string clamp 130. Levers 125 may also be configured to rotate in a second direction to loosen string clamp 130. In other embodiments, more or fewer levers 125 may be positioned on locking system 120, and each of the levers 125 may be associated with more offer strings 107.

Each lever 125 may include an arm or projection 127 that is configured to extend away from a body of lever 125. The projection 127 may be configured to increase the mechanical advantage of lever 125 to increase the torque of lever 125 to more efficiently rotate lever 125.

Figure 2:
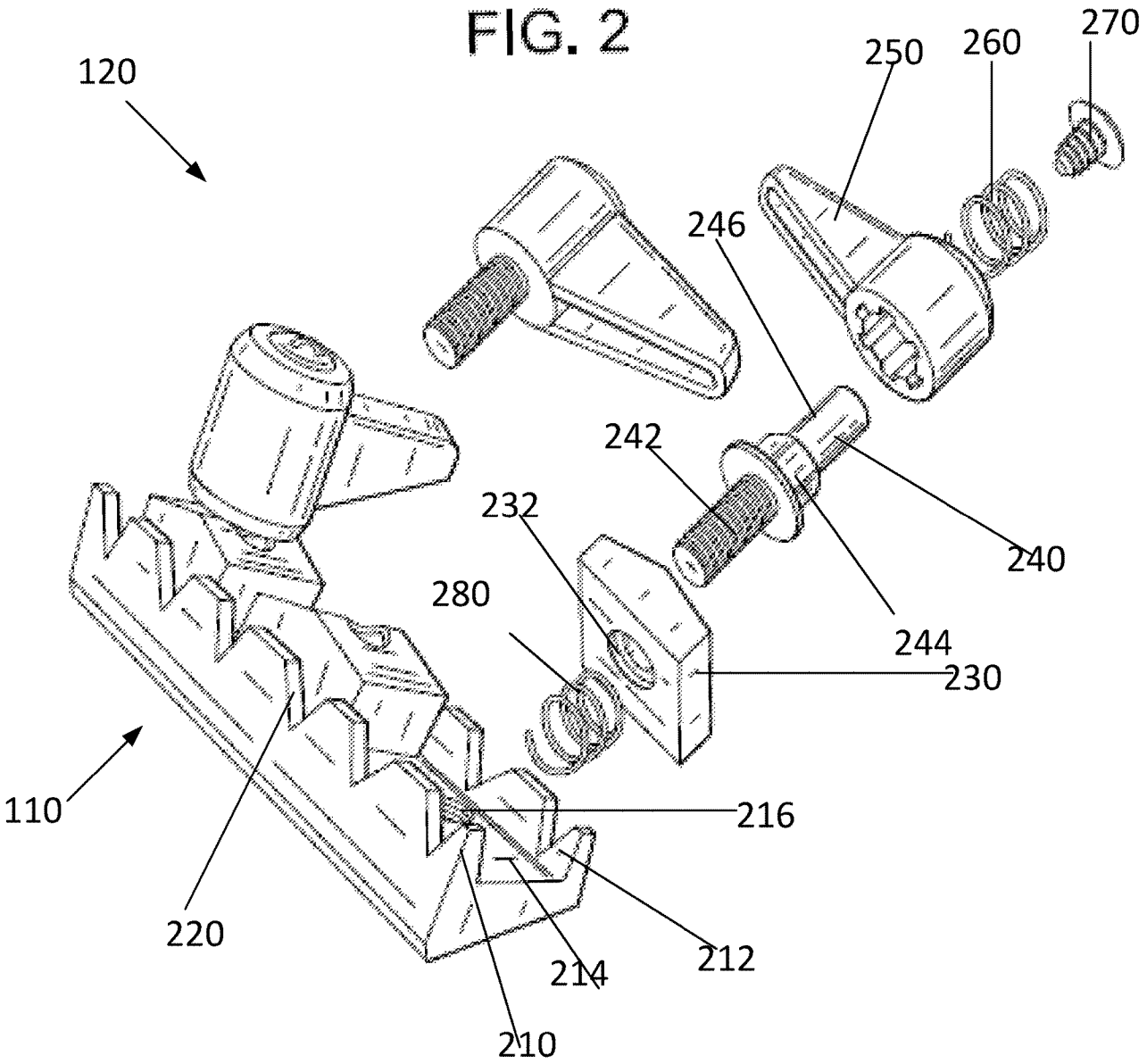
FIG. 2 depicts an exploded via of a locking base and locking system, according to an embodiment.

FIG. 2 depicts an exploded via of locking base 110 and locking system 120, according to an embodiment. As depicted in FIG. 2, locking base 110 may include a first sidewall 210, second sidewall 212, channel 214, and tightening post receivers 216.

First sidewall 210 may be positioned on a first side of locking base 110, and second sidewall 212 may be positioned on a second side of locking base 110. First sidewall 210 and second sidewall 212 may be configured to extend away from an upper surface of locking base 110 to form channel 214 between first sidewall 210 and second sidewall 212. First sidewall 210 and second side wall 212 may include aligned notches, grooves, indentations, etc. (referred to hereinafter individually and collectively as "notches 220").

Notches 220 may be substantially "V-Shaped", wherein strings of a musical instrument are configured to be positioned within notches 220. The notches 220 may be configured to assist in anchoring the strings in place with proper spacing.

Channel 214 may be configured to extend from a first end of locking base 110 to a second end of locking base 110. Channel 214 may have a width that is long enough to receive string clamps 232. Positioned at even intervals through channel 214 may be tightening post receivers 216. Tightening post receivers 216 may be threaded holes, fasteners, etc. positioned through locking base 110.

Locking system 120 may include string clamps 230, tightening posts 240, and levers 250.

String clamps 230 may be configured to be inserted onto an upper surface of channel 214 on locking base 110. Strings clamps 230 may be positioned between first sidewall 210 and the second sidewall 212.

String clamps 230 may have a clamping surface that is configured to anchor the strings in place between the clamping surface and channel 214. String clamps 230 may also include holes 232. Holes 232 may extend through a body of string clamps 230, wherein holes 232 are configured to align with tightening post receivers 216. As tightening posts 240 are tightened, tightening posts 240 may apply force to position sting clamp 230 more proximate to locking base 110 so that guitar strings may be anchored between locking base 110 and string clamps 230. In embodiments, three string clamps 230 may be used, wherein each string clamp 230 is configured to anchor two strings. However, in different embodiments a different number of strings clamps 230 may be used.

The tightening posts 240 may include a threaded portion 242, lever engagement mechanism 244, smooth shaft 246, spring 260, and screw 270.

Threaded portion 242 may be configured to be inserted through the hole 232 in string clamp 230, and the tightening post receivers 216 within the locking base 110. Responsive to turning tightening post 240 in a first direction, more of threaded portion 242 may be configured to be inserted into tightening, post receivers 216 and hole 232. Responsive to turning tightening post 240 in a second direction, less of threaded portion 242 may be configured to be inserted into tightening post receivers 216 and hole 232.

Lever engagement mechanism 244 may be positioned between threaded portion 242 and smooth shaft 246. Lever engagement mechanism 244 may be configured to allow lever 250 to engage and disengage with tightening post 240 to tighten or loosen tightening post 240. Lever engagement mechanism 244 may have a polygonal shape, such as a hexagon, octagon, etc., wherein a bottom surface of lever 250 may have a corresponding shape. Responsive to placing lever 250 onto lever engagement mechanism 24, the polygonal shape may be configured to receive force from lever 250 to turn tightening post 240.

Smooth shaft 246 may be positioned above lever engagement mechanism 244, and may have a diameter that is less than a diameter of lever engagement mechanism 244. Responsive to moving lever 250 around smooth shaft 246, smooth shaft 246 may be configured to allow lever 250 to be rotated without turning tightening post 240.

Lever 250 may be configured to disengage and engage with the tightening post 240 to tighten or loosen the tightening post 240 within locking base 110. Lever 250 may have a hollow chamber extending through a body of lever 250. A lower surface of the hollow chamber may be configured to receive tightening post 240 and an upper surface of the hollow chamber may be configured to receive screw 270, wherein spring 260 may be stored within the hollow chamber.

A bottom surface of the hollow chamber associated with lever 250 may have an opening with a shape corresponding to a shape of the lever engagement mechanism 244. In embodiments, responsive to vertically moving lever 250, lever 250 may be disengaged with the lever engagement mechanism 244, and be rotated in the first or section direction without tightening or loosening string clamp 230. This action may allow for reciprocal movement within the tight confines of adjacent string clamps 130 and tightening posts 240 in a musical instrument.

In other words, responsive to moving lever engagement mechanism 244 within the opening on the bottom surface of lever 250, lever 250 may be engaged with tightening post 240. When lever 250 is engaged with the lever engagement mechanism 244 and rotated in a first direction, the threaded portion 242 of the tightening post 240 may be tightening into the locking base 110 to anchor one or more strings between the locking base 110 and the string clamp 230. Responsive to the lever 250 being engaged with the lever engagement mechanism 244 and rotated in a second direction, string clamp 230 may be loosened or moved away from locking base 110. Lever 250 may remain coupled to tightening post 240 when engaged or disengaged so that lever 250 is always accessible to a user.

Spring 260 may be configured to be positioned between an upper surface of lever 250 and screw 270 wherein spring 260 may be positioned within the hollow chamber within lever 250. Spring 260 may be configured to be compressed or stretched slightly from rest. In embodiments, responsive to lever 250 being vertically raised, spring 260 may be compressed such that smooth surface 246 may be encompassed by the body of lever 250. Thus, when spring 260 is compressed, lever 250 may be disengaged from tightening post 240. Spring 260 may be configured to be elongated when a user is not applying upward force to lever 250. Accordingly when no force is applied to lever 260, lever 250 may be engaged to tightening post 240. In other embodiments, spring 260 may be positioned below lever 250, such that when no pressure is applied to lever, spring 260 may positioned lever 250 in the disengaged position. In an alternative embodiment, when spring 260 is positioned below lever 250, a user may apply downward pressure to lever 250 to position lever 250 in the engaged position 260 with lever engagement mechanism 244.

Screw 270 may be configured to be positioned above spring 260, and may be configured to be coupled to the upper surface of lever 250 and contact an upper surface of tightening post 240. In embodiments, screw 270 may be inserted into or screwed into the tightening post 240. Screw 270 may be configured to apply pressure against spring 260 to retain spring 260 in the elongated position when no force is applied to lever 250, or apply pressure against spring 260 to allow spring 260 to compress when upward force is applied to lever 250.

Embodiments may also include a spring 280 that is configured to be positioned between a lower surface of string clamp 230 and channel 214. Spring 280 may be configured to be compressed and decompressed to assist in the anchoring of strings. Responsive to turning tightening post 240 in a first direction, spring 280 may become compressed. Responsive to turning tightening post 240 in a second direction, spring 280 may become decompressed. A first end of spring 280 may be configured to be positioned within a recessed ledge within hole 232, wherein the first end of spring 280 may apply pressure against the recessed ledge to move string clamp 230 away from channel 214.

Figure 3:
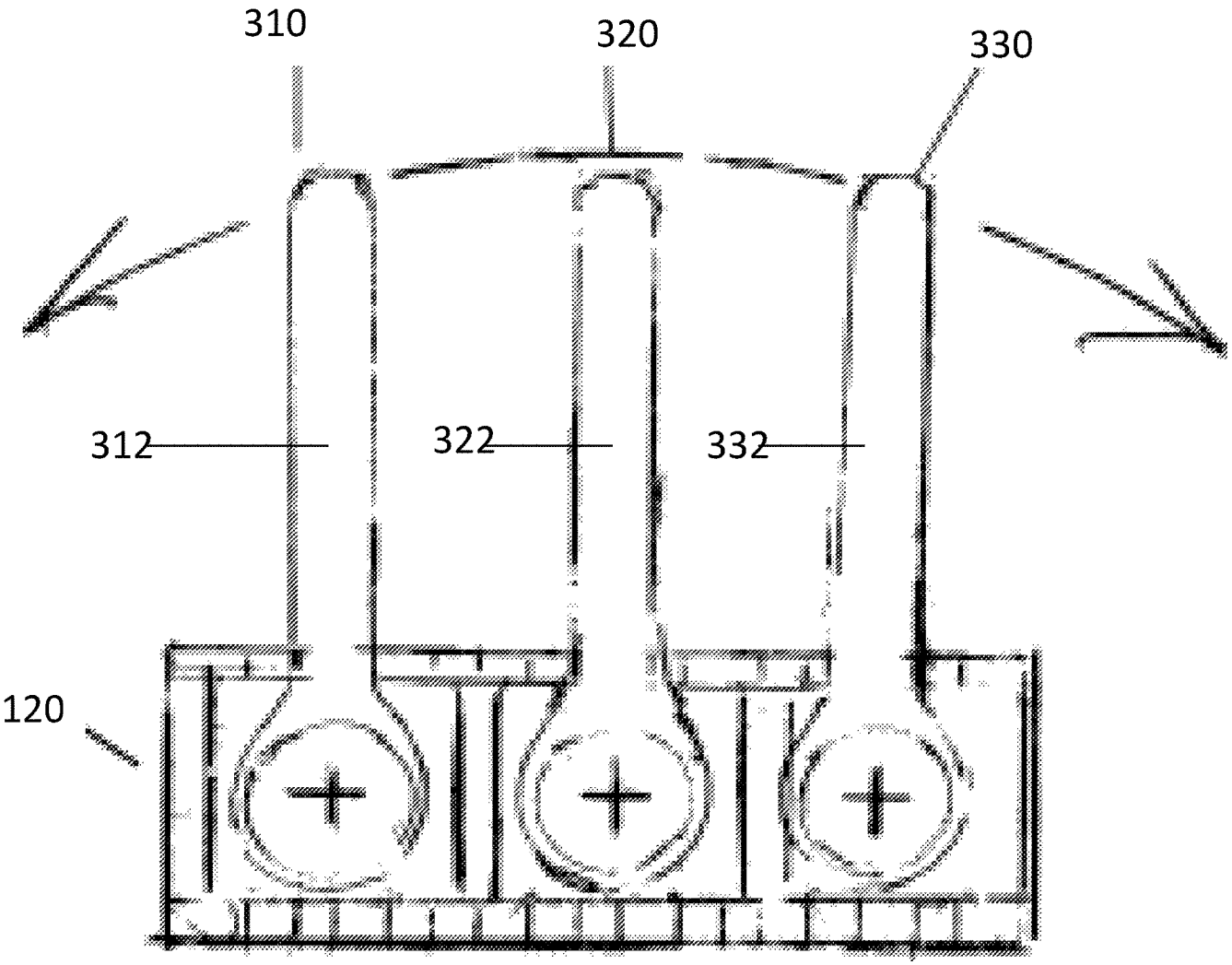
FIG. 3 depicts a top view of a locking system, according to an embodiment.

FIG. 3 depicts a top view of locking system 120, according to an embodiment. As depicted in FIG. 3, locking system 120 may include a plurality of levers 250, including a first lever 310, second lever 320, and third lever 330. Each of the levers 310, 320, 330, may individually rotate to clamp corresponding tightening posts and string clamps against a locking base.

Each of the levers 310, 320, 330 may include a corresponding projection 312, 322, 332, which can each be rotated in a first direction and/or a second direction independently and simultaneously. The rotation of the first projection 312 may be limited based on the positioning of the second projection 322, the rotation of the second projection 322 may be limited based on the positioning of the first projection 312 and the third projection, and the rotation of the third projection 322 may be limited based on the positioning of the second projection 322. Accordingly, based on the positioning of the projections 312, 322, 332 the angle of rotation allowable for each lever 250 may be dynamically changed, wherein the angle of rotation for each of the levers 250 may be different from each of the other levers.

Figure 4:
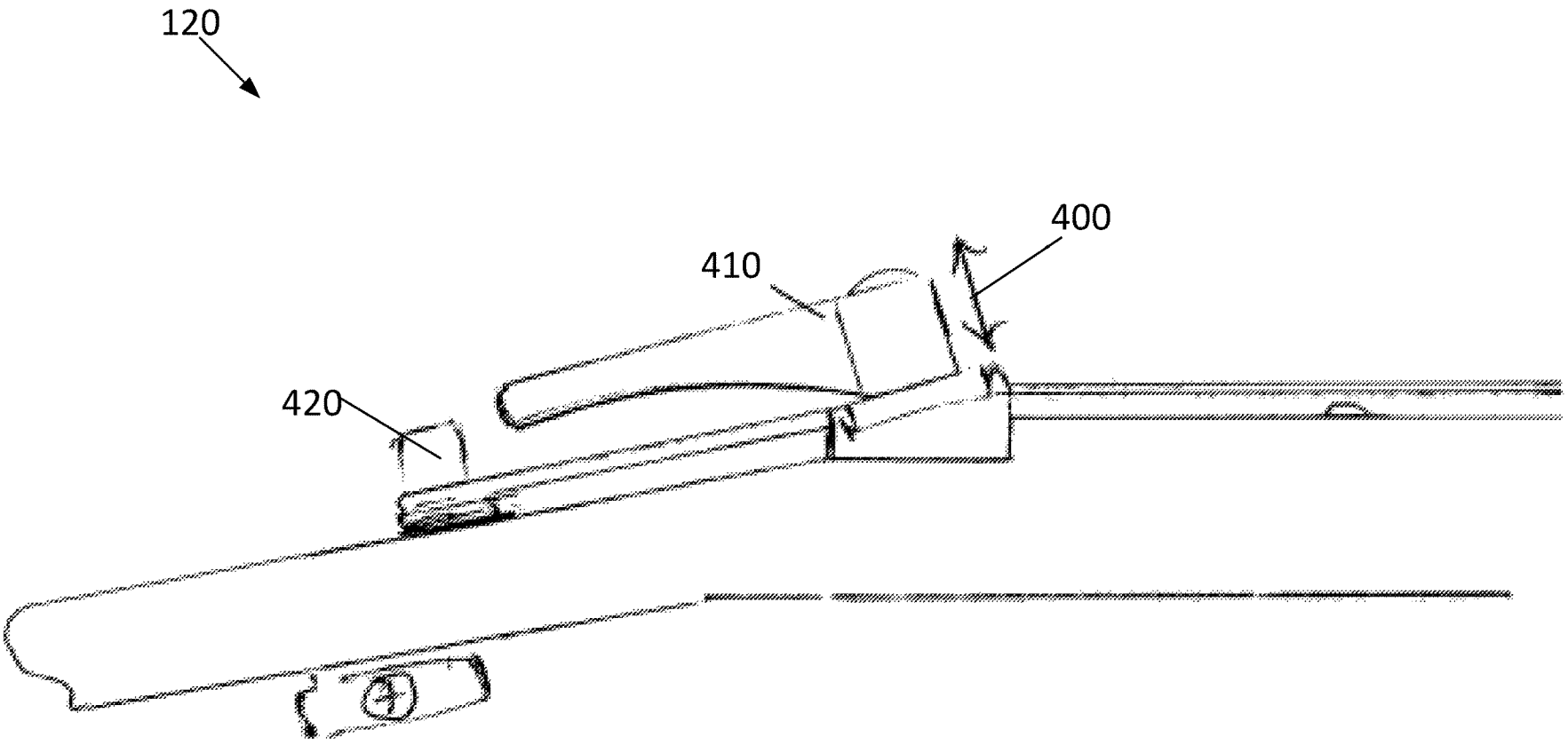
FIG. 4 depicts a side view of a locking system, according to an embodiment.

FIG. 4 depicts a side view of locking system 120, according to an embodiment. As depicted in FIG. 4, a projection 410 associated with a lever 400 may run substantially parallel to a headstock of the musical instrument, and perpendicular to a body of lever 400. A length of the projection 410 may be less than a distance between lever 400 and a tuner 420 of the musical instrument.

In embodiments, the vertical movement of lever 400 and the positioning of a tightening post may be offset from an angle of the neck of the musical instrument.

Figure 5:
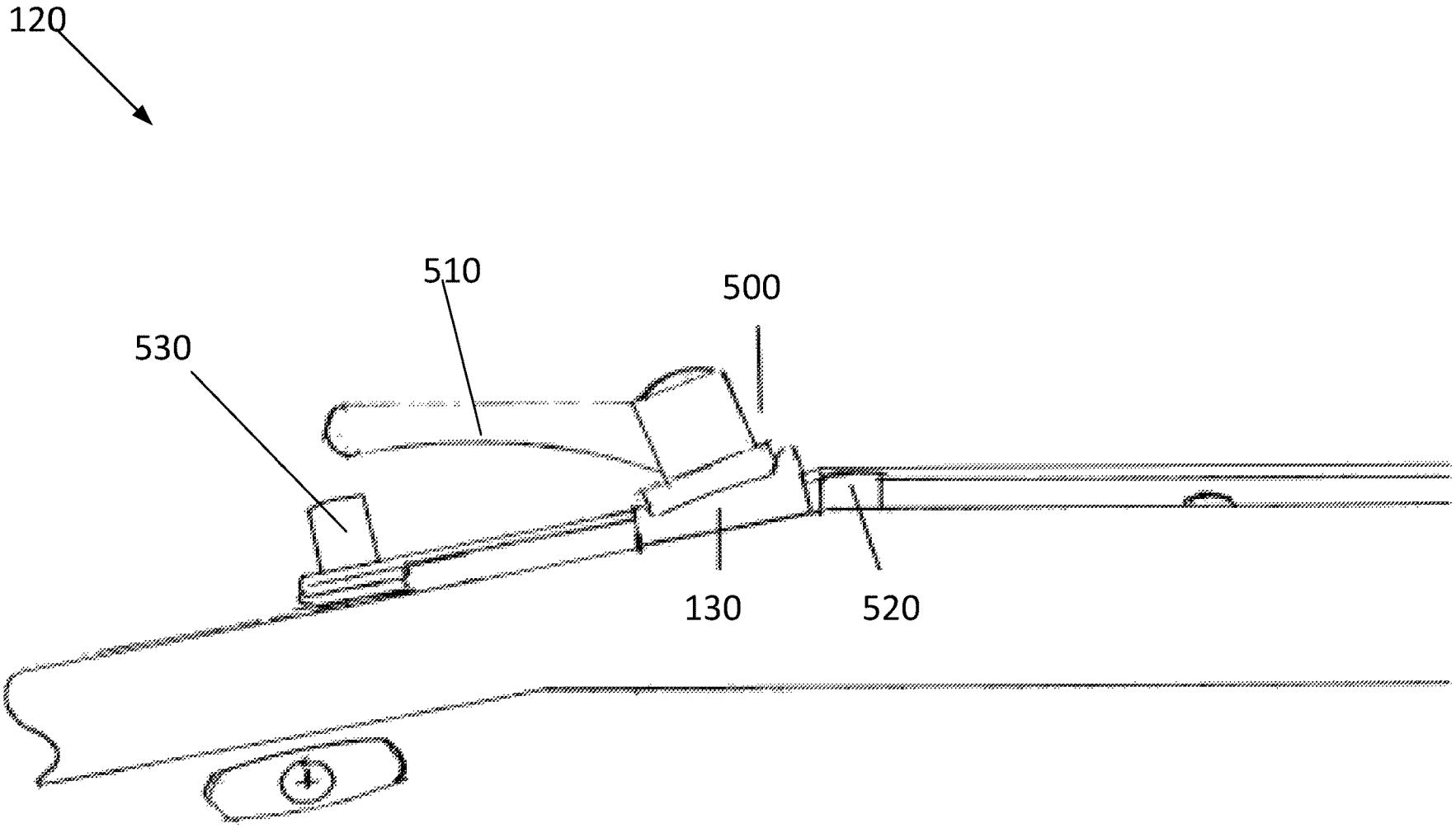
FIG. 5 depicts a side view of a locking system, according to an embodiment.

FIG. 5 depicts a side view of locking system 120, according to an embodiment. As depicted in FIG. 5, a projection 510 associated with a lever 500 may be retrofitted to a musical instrument with an existing nut so that the existing nut may function with a keyless locking base without the necessity of removing the existing nut from the musical instrument. As further depicted in FIG. 5, lever 550 may be positioned in between the nut 520 and tuner 530 of the musical instrument. Additionally, projection 510 may be positioned at an angle with regards to the post of the guitar. Therefore, an end of projection 510 may be configured to be positioned over a tuner 530.

Figure 6:
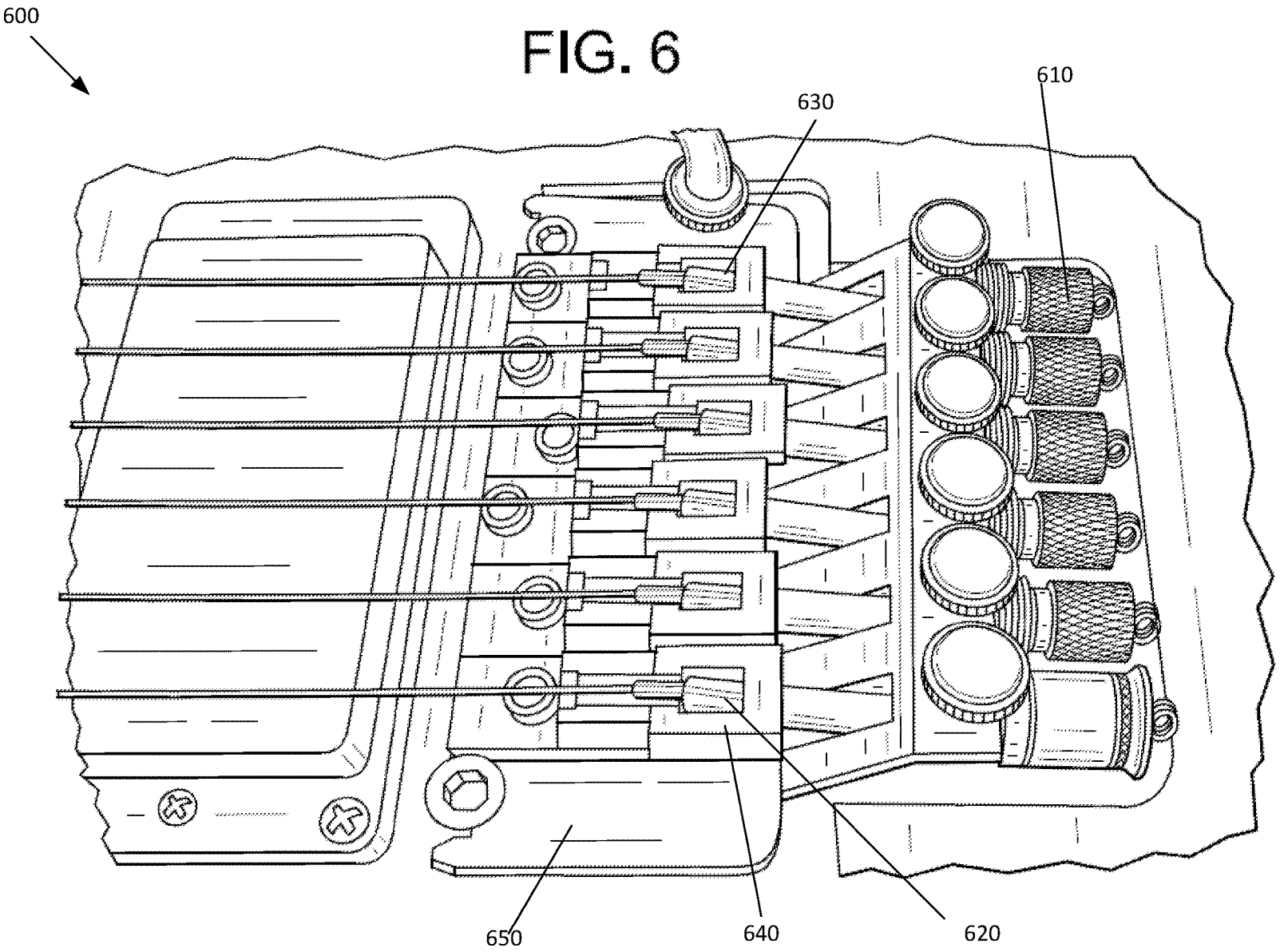
FIG. 6 depicts a keyless tremolo locking system that may be retrofitted to an existing locking tremolo, according to an embodiment.

FIG. 6 depicts an embodiment of a keyless tremolo locking system 600 that may be retrofitted to an existing locking tremolo. Keyless locking system 600 may be a secondary locking system positioned at a tremolo. Keyless locking system 600 includes a plurality of circumferential clamps 610, which are each configured to anchor a first end of guitar strings 620. Each guitar string 620 may be positioned over a saddle rain 630 in a saddle assembly 640 in a tremolo base 650.

Each circumferential clamp 610 may be configured to be aligned longitudinally with a string 620 so that string 620 is held substantially along it's circumference without requiring a bend in string 620 at the point of clamping. This may allow circumferential clamp to hold string 620 at the ball end and not force a 90 degree bend in the sting 620.

Figure 7:
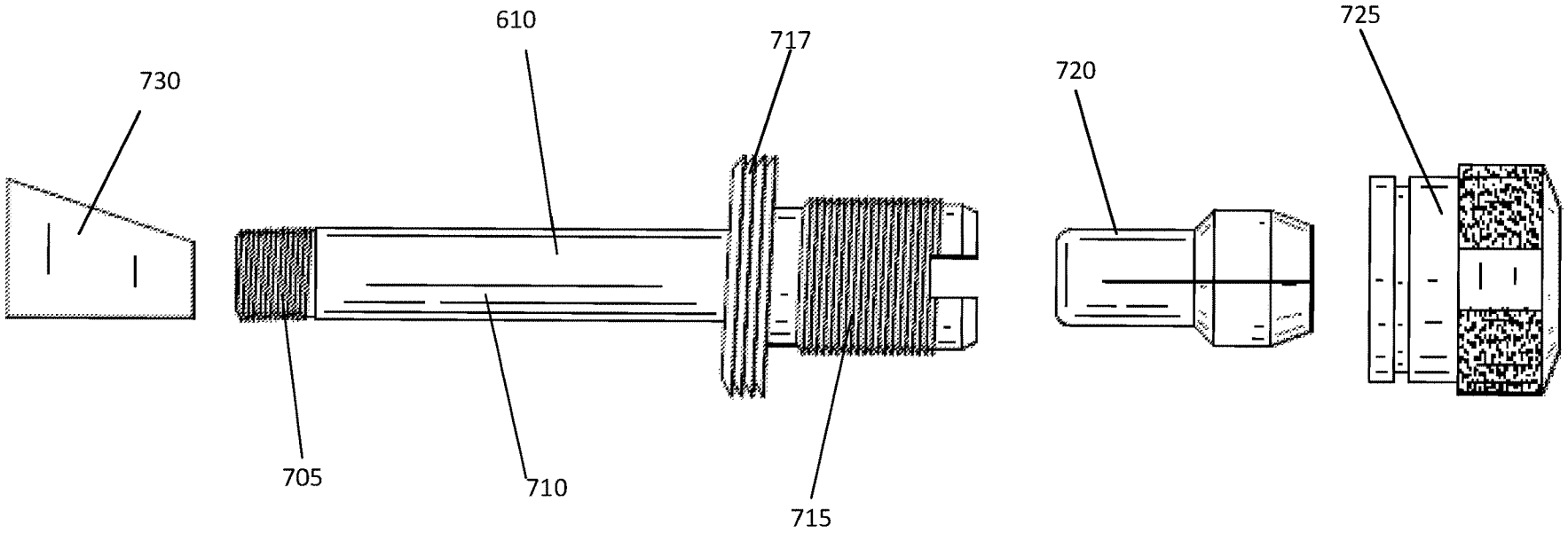
FIG. 7 depicts an exploded view of a circumferential clamp, according to an embodiment.

FIG. 7 depicts an exploded view of a circumferential clamp 610, according to an embodiment. Circumferential clamp 610 may include a threaded end 705, a shaft 710, lock closer threads 715, clamping member 720, lock closer 725 and saddle ramp 730, wherein circumferential clamp 610 includes a hollow chamber extended from threaded end 705 to clamping member 720. In embodiments a musical instrument string may be configured to be positioned through the hollow chamber.

Threaded end 705 of circumferential clamp 610 may be configured to be coupled with a saddle assembly, wherein threaded end 705 may be screwed into the saddle assembly.

Shaft 710 may be positioned between threaded end 705 and lock closer threads 715, and shaft 710 may not have threaded sidewalls. In embodiments, shalt 710 may also include intonation threads 717. Intonation threads may be configured to receive an intonation adjustment head.

Lock closer threads 715 may be configured to receive lock closer 725, wherein lock closer 725 may be screwed onto the threads of lock closer threads 715. Responsive to turning lock closer 725 in a first direction, lack closer 725 may tighten and compress clamping member 720 around the string.

Clamping member 720 may be a collet configured to anchor the string forward of the ball end, wherein the ball end of the string may be cut, or retained to facilitate removal of a broken string. In embodiments, clamping member 720 may be configured to be inserted into and removed from a hollow chamber extending through circumferential clamp 610. Clamping member 720 may be configured to form a collar around the string to anchor the string in place. Clamping member 720 may exert a strong clamping force on the string when tightened. Clamping member 720 may include a sleeve with a cylindrical inner surface and a conical outer surface. The collet of clamping member 720 may be squeezed such that its inner surface contracts to a smaller diameter, anchoring the string in place. In embodiments where the ball end is retained, the string may be positioned through lock closer 725, ahead of the ball end, and anchored via clamping member 720.

Lock closer 725 may be may be configured to be rotated to anchor the string ahead of the ball end of the string. Responsive to mating threads within lock closer 725 with lock closer threads 715 and rotating lock closer 725 in a first direction, lock closer 725 may squeeze clamping member 720 such that the diameter of clamping member 720 is decreased. By decreasing the diameter of clamping member 720, the inner sidewalls of clamping member 720 may apply a clamping force against the string to anchor the string in place. By concentrically clamping the circumference of the string ahead of the ball end via lock closer 725 and tightening clamping member 720, any issue of slack between the ball end and a wire loop may be negated. When the string is tensioned up to pitch, clamping member 720 and lock closer 725 may be configured to prevent the ball end of the string from pulling through the clamping member 720. Responsive to a tremolo arm being depressed or raised to allow the string tension to decrease or increase, the clamping force of lock closer 725 on clamping member 720 may be sufficient to prevent the string from reversing out or being pulled out of the locking mechanism. In embodiments, responsive to rotating threads within lock closer 725 with respect to lock closer threads 715 in a second direction, lock closer 725 may loosen clamping member 720. This may allow the diameter of clamping member 720 to increase.

Saddle ramp 730 may be configured to guide the string over a portion of a tremolo from the hollow chamber of circumferential clamp 610. Saddle ramp 730 may include a first edge that is longer than a second edge, and an inclined top surface. The inclined surface is configured to guide the musical instrument string. In embodiments, the combination of saddle ramp 730 and circumferential clamp 610 may be configured to allow conversion of conventional locking tremolos to a keyless locking system. Saddle ramp 730 may be configured to allow a string to more easily pass through and over a conventional locking string saddle. Saddle ramp 730 may have a lower break angle over the saddle via the inclined top surface, which is less than a ninety degree angle. This may reduce string breakage.

Figure 8:
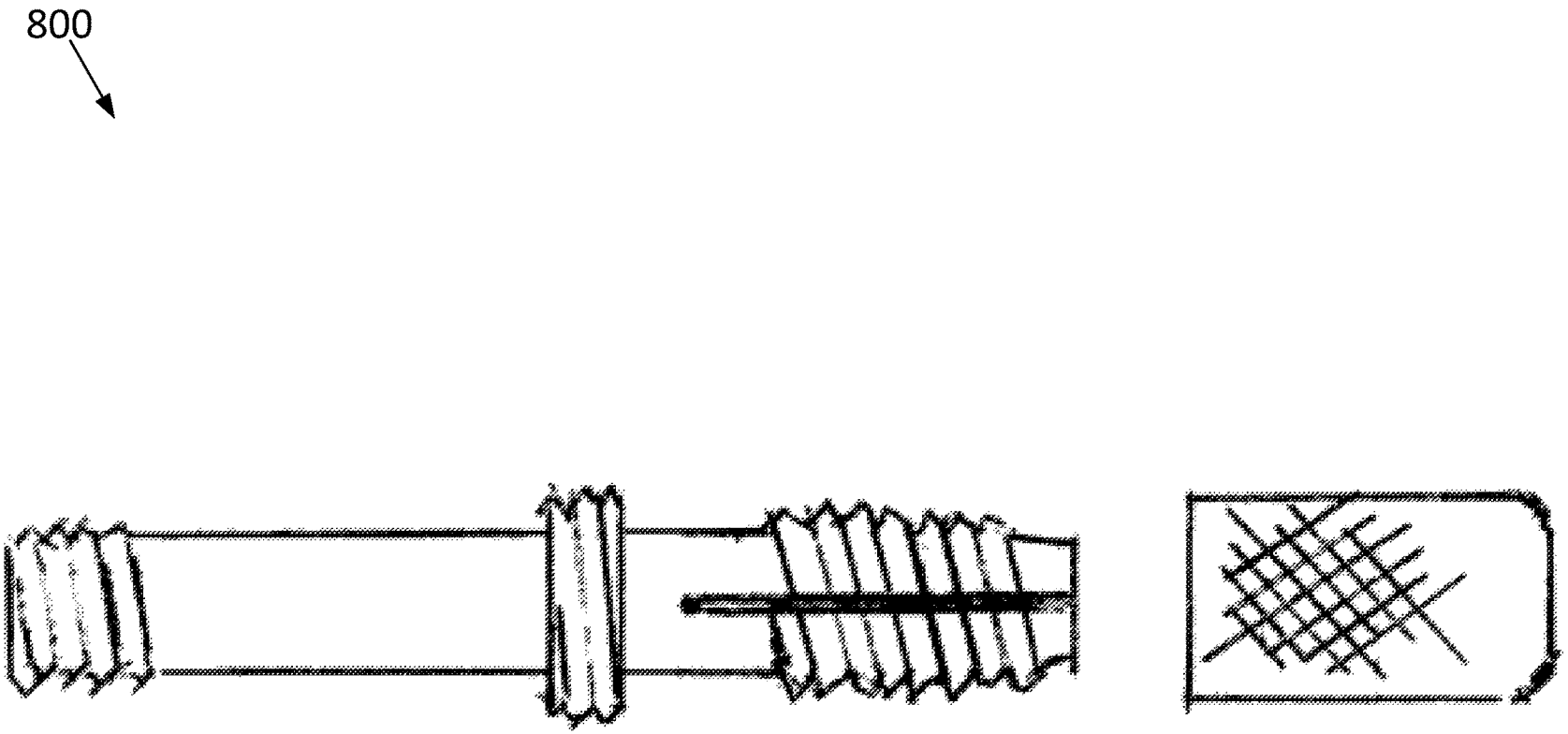
FIG. 8 depicts a circumferential clamp, according to an embodiment.

FIG. 8 depicts a circumferential clamp 800, according to an embodiment. As depicted in FIG. 8, circumferential clamp 800 may include a threaded area on the first end and the second end. The threaded area on the second end of circumferential clamp 800 may be configured to receive an intonation adjustment head (not shown). The intonation adjustment head may be an internally threaded knurled cylinder that concentrically surrounds the closer, and is threaded onto a body of the second locking system. The threaded knurled cylinder may be configured to finely adjust the intonation of the musical instrument. The threaded knurled cylinder may be configured to be positioned against an edge of a tremolo base plate holding a loose, saddle in place while adjusting the saddle for correct intonation.

Figure 9:
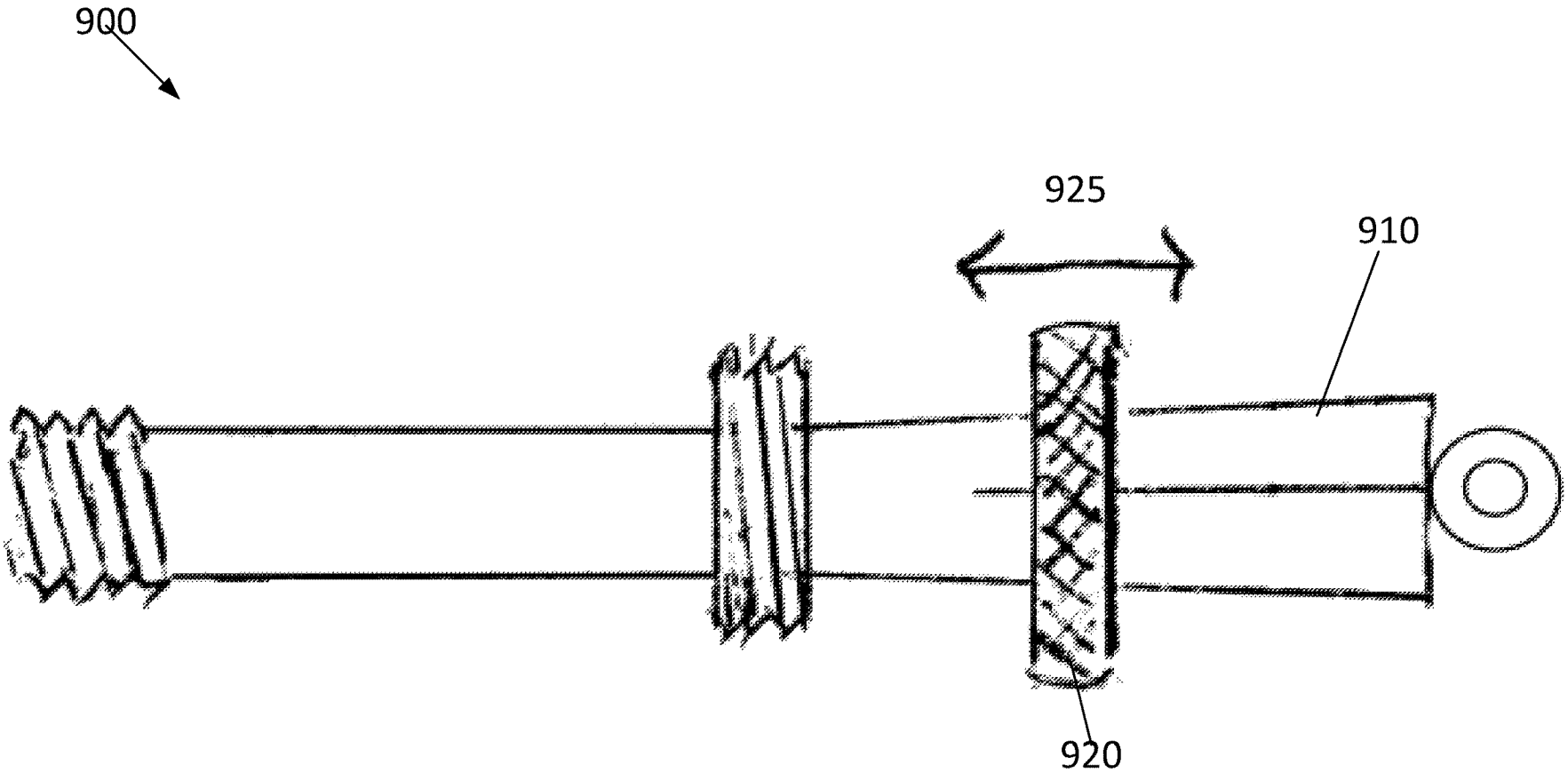
FIG. 9 depicts a circumferential clamp, according to an embodiment.

FIG. 9 depicts a circumferential clamp 900, according to an embodiment. As depicted in FIG. 9, circumferential clamp 900 may have a tapered second end 910 and a sliding collar 920. Sliding collar 920 may be configured to slide between a threaded area and the second end 910 of circumferential clamp 900. Responsive to positioning sliding collar 920 more proximate to the second end 910 of circumferential clamp 900, the tapered second end may compress to anchor a string within a hollow chamber of circumferential clamp 900. Responsive to positioning sliding collar 920 more proximate to the threaded area, the tapered second end may expand to allow the string to move within the hollow chamber.

Figure 10:
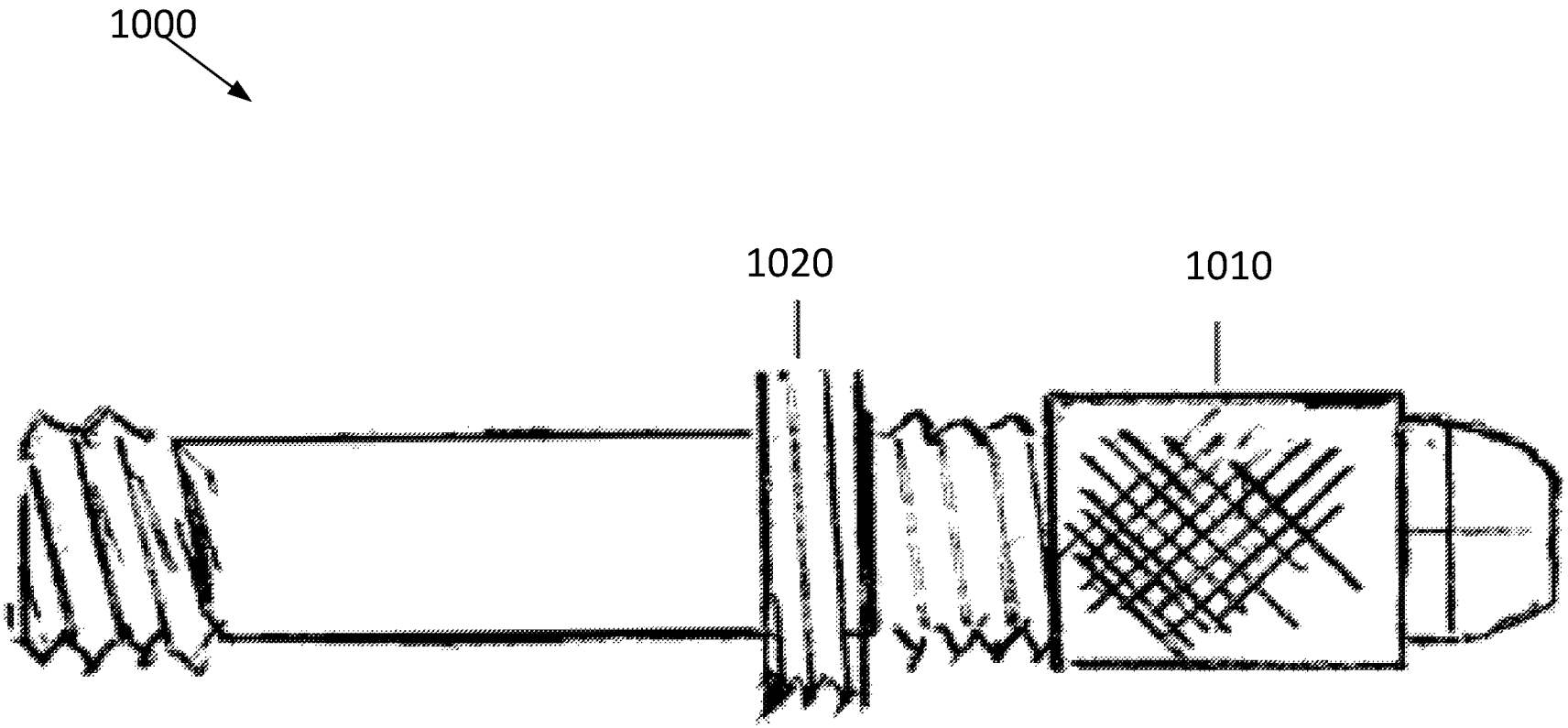
FIG. 10 depicts a circumferential clamp, according to an embodiment.

FIG. 10 depicts a circumferential clamp 1000, according to an embodiment. As depicted in FIG. 10, circumferential clamp 1000 may include a reverse closer 1010, and circumferential clamp 1000 may be a collet that is tightened against a string when closer 1010 is moved outward towards the second end of circumferential clamp 1000. In embodiments, a threaded area 1120 on the shaft of circumferential clamp 1000 may be configured to receive an intonation adjustment head.

Figure 11:
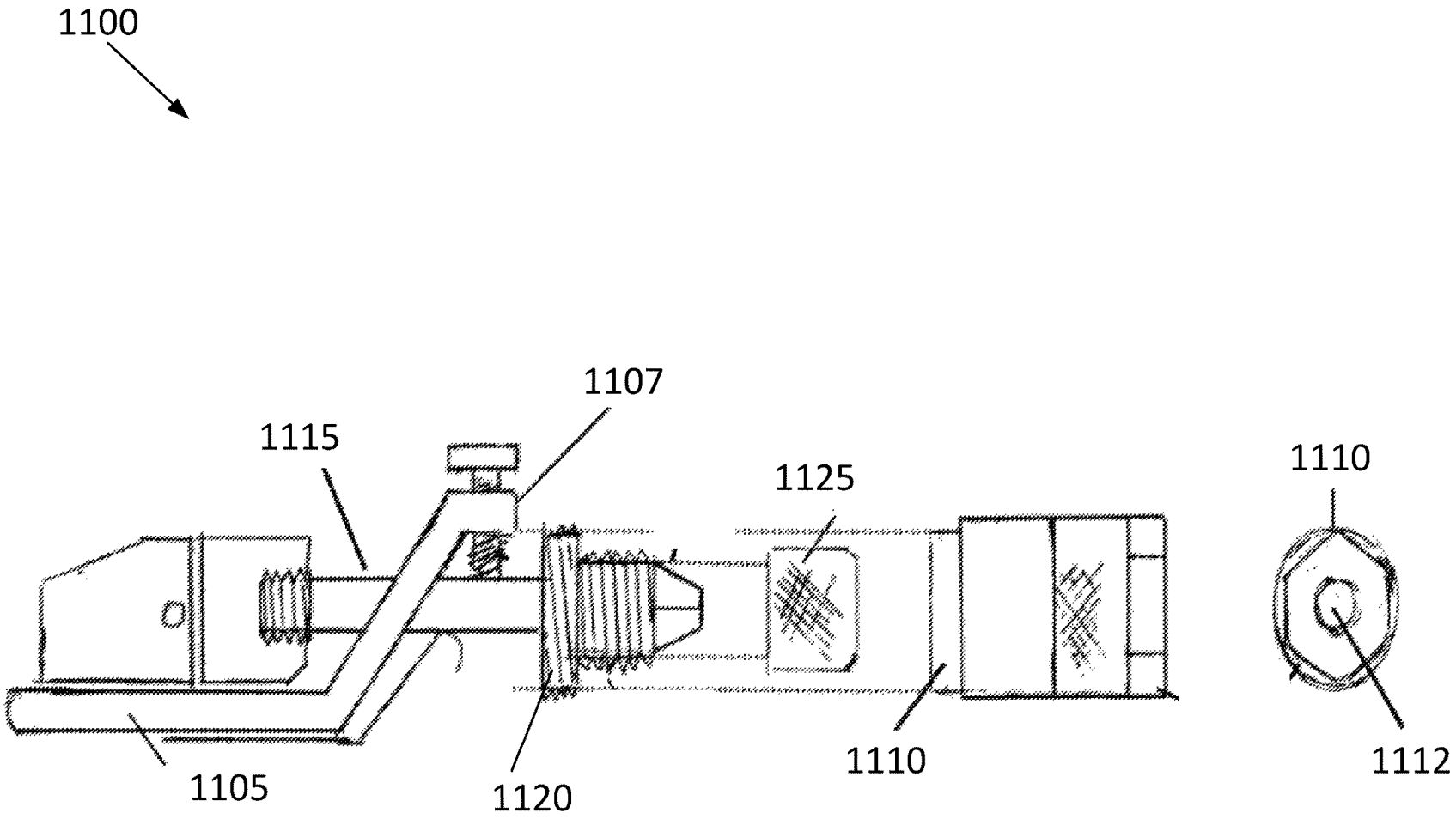
FIG. 11 depicts a side view and top view of a keyless tremolo lock with an intonation adjustment head, according to an embodiment.

FIG. 11 depicts a side view and top view of a keyless tremolo lock 1100 with an intonation adjustment head 1110, according to an embodiment. In embodiments intonation adjustment head may be configured to be coupled with circumferential clamp 1115 and bear against a tremolo baseplate 1105 to provide intonation adjustment of a string saddle while the string is under tension.

As depicted in FIG. 11, the intonation adjustment head 1110 is configured to be coupled with a threaded area 1120 of circumferential clamp 1115, wherein intonation adjustment head 1110 may include a hollow chamber with an inner circumference. Intonation adjustment head may be configured to encompass lock closer 1125 when lock closer 1125 is coupled to lock closer threads 1130. When intonation adjustment head 1110 is coupled with threaded area 1120, an outer circumference of lock closer 1125 may be positioned adjacent to an inner circumference of intonation adjustment head 1110.

Intonation adjustment head 1110 may include a swivel joint 322 and central bore 324. Swivel joint 322 may configured to allow intonation adjustment head 1110 to freely turn to finely adjust the string. The fine adjustment of the intonation may be accomplished by turning intonation adjustment head 110 by hand, or alternatively using a wrench on central bore 324, or other tool which engages the intonation adjustment head 1110. Intonation adjustment head 1110 may be configured to bear against the edge of the tremolo base plate 1105 holding a loosened saddle in place while the string is under tension. This may simulate depressing a tremolo to release the string tension in order to adjust the intonation of the musical instrument. Accordingly, intonation adjustment head 1110 may not require the tremolo to be depressed to release the string tension. By circumferential clamp 1115 being positioned adjacent to rearward edge 1107 of tremolo baseplate 1105, intonation adjustment head 1110 may finely adjust a string saddle, wherein the intonation adjustment head 1110 may not interfere with the fine tuner while allowing a single intonation adjustment head to be used on all strings. This may reduce time required for checking, detuning, or retuning strings. Additionally, this may eliminate the tedious trial and error of intonating a locking tremolo.

Figure 12:
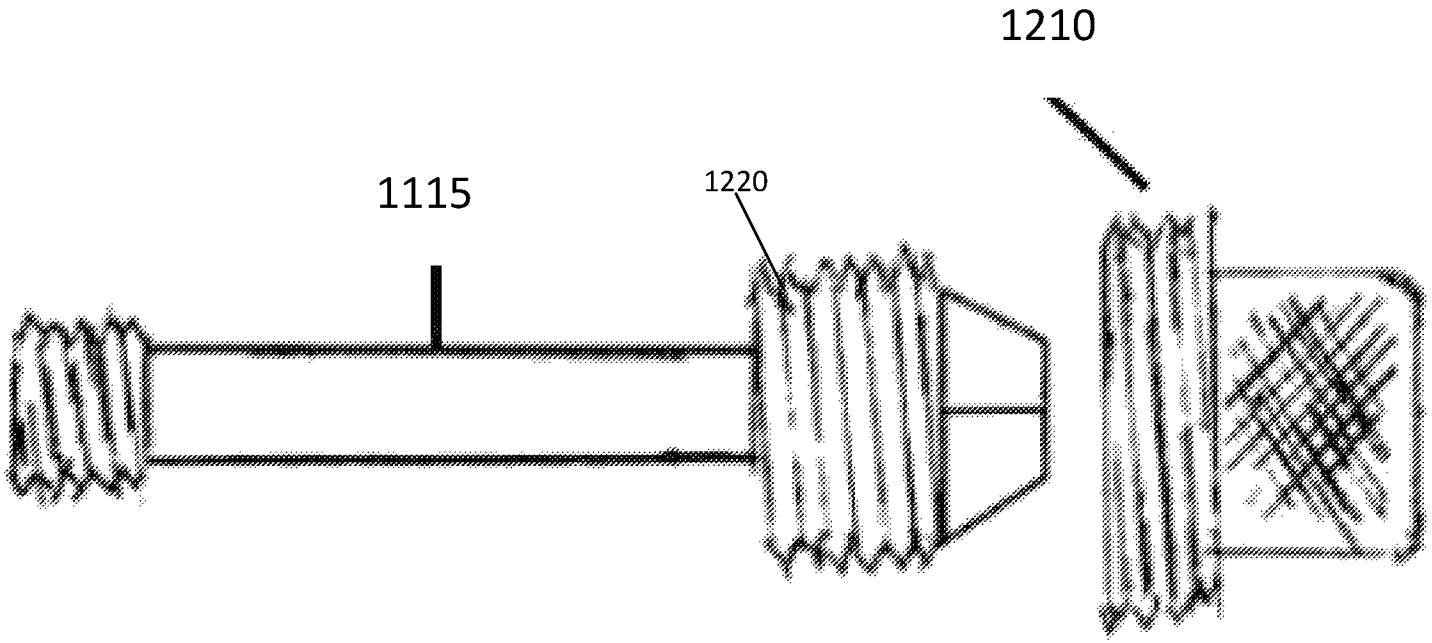
FIG. 12 depicts a side view and top view of a keyless tremolo lock with an intonation adjustment head, according to an embodiment.

FIG. 12 depicts a side view and top view of a keyless tremolo lock 1200 with an intonation adjustment head 1210, according to an embodiment. As depicted in FIG. 12, a threaded area 1220 is positioned on lock closer 1230 instead of on the shaft of the shaft 1230.

Figure 13:
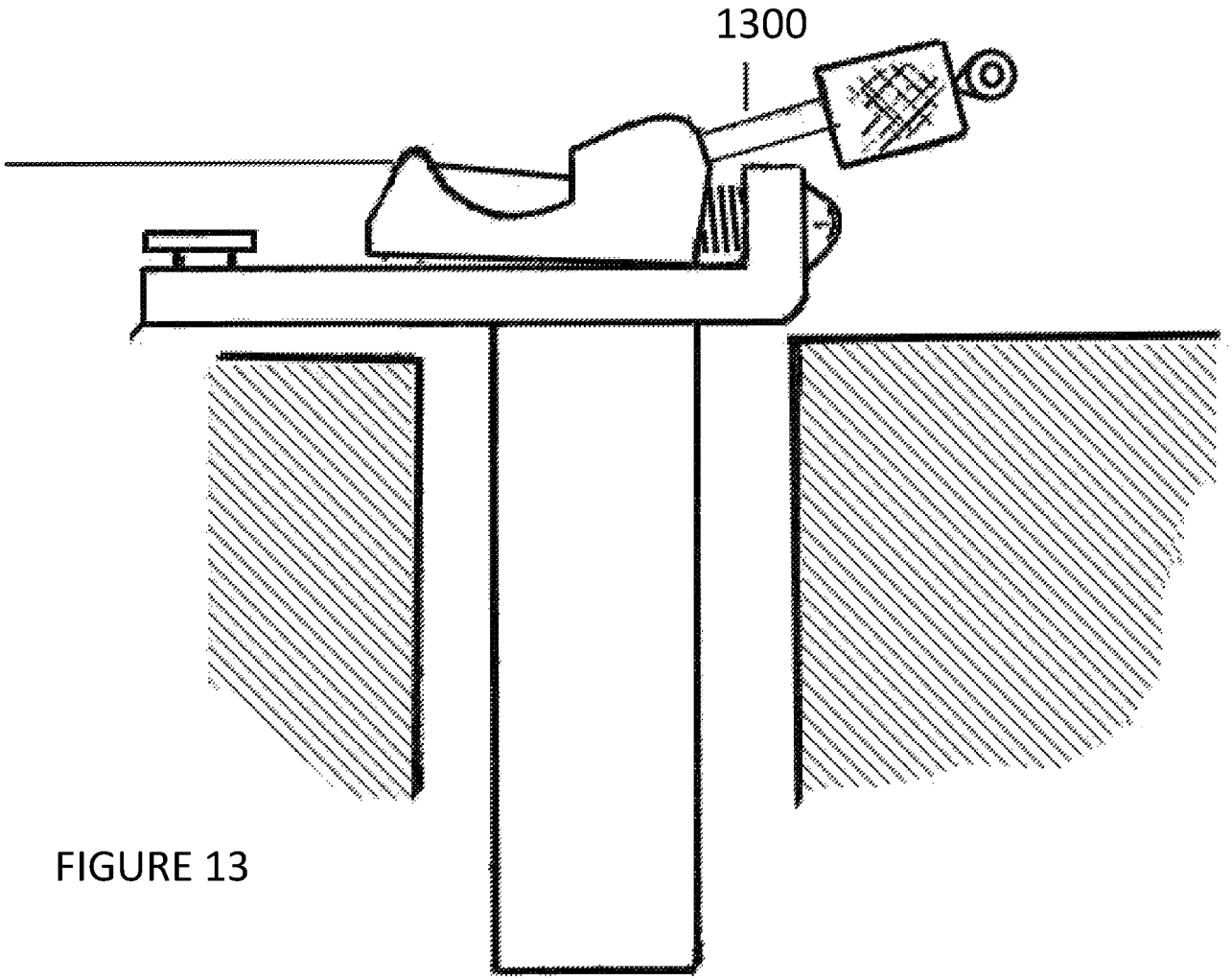
FIG. 13 depicts a side view of a keyless tremolo lock and string saddle assembly for converting non locking tremolos to locking according to an embodiment.
Figure 14:
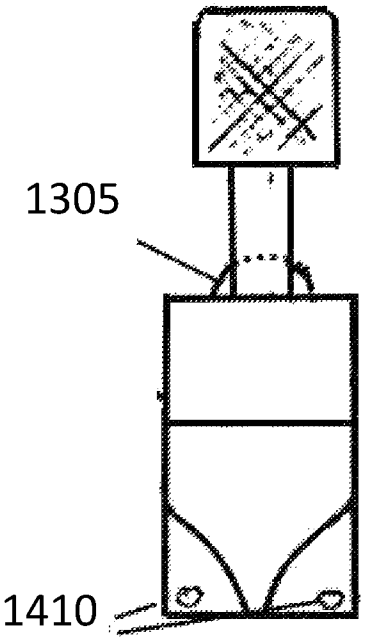
FIG. 14 depicts a top view of keyless tremolo lock and string saddle, according to an embodiment.

FIG. 13 depicts a side view of a keyless tremolo lock string saddle 1300 for a non-locking tremolo, which may be configured to replace an existing non-locking saddle. Keyless locking tremolo saddle 1300 may include an intonation screw 1305 that is configured to adjust the position of keyless locking tremolo saddle 1300. As depicted in FIG. 14, a top view of keyless locking tremolo saddle 1300, saddle height adjustment screws 1410 may be configured to allow for individual precise adjustment of keyless lock 1300 to match the radius of any fingerboard of a musical instrument.

Figure 15:
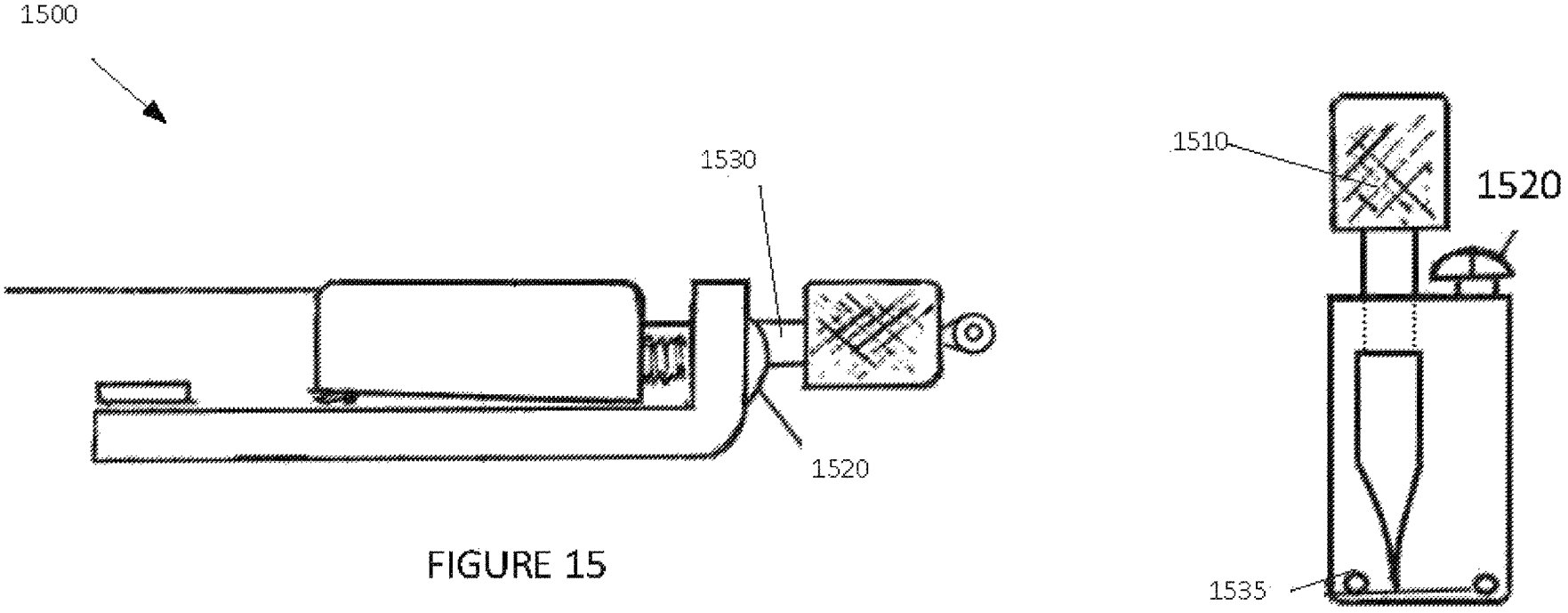
FIG. 15 depicts a side view and a top view of keyless tremolo lock, according to an embodiment.

FIG. 15 depicts a side view of keyless tremolo lock 1500, and a top view of keyless tremolo lock 1500, according to embodiments. Keyless lock 1500 may include a circumferential string clamp 1510 and an intonation screw 1520 to adjust the position of tremolo lock 1530. In embodiments, saddle height adjustment screws 1535 may be configured to allow precise adjustment of tremolo lock 1530 to match the radius of a neck of a musical instrument. This may allow a drop in replacement of a conventional tremolo assembly that has a better profile with lower positioned locks.

Figure 16:
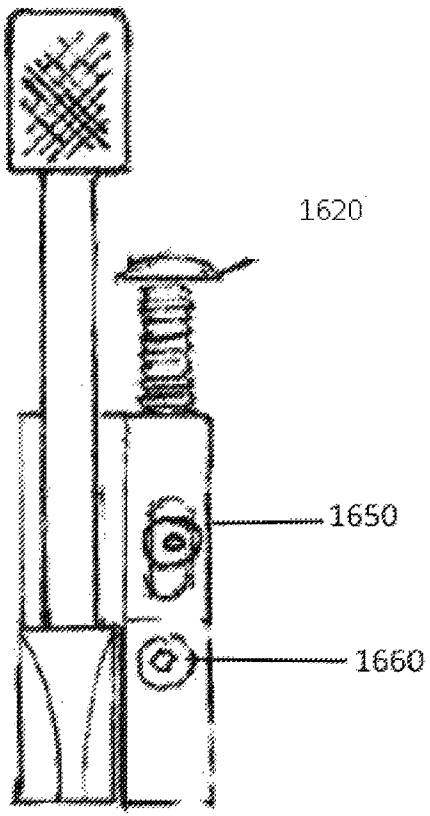
FIG. 16 depicts a side view and a top view for a replacement assembly for a keyless locking fulcrum tremolo, according to an embodiment.
Figure 16:
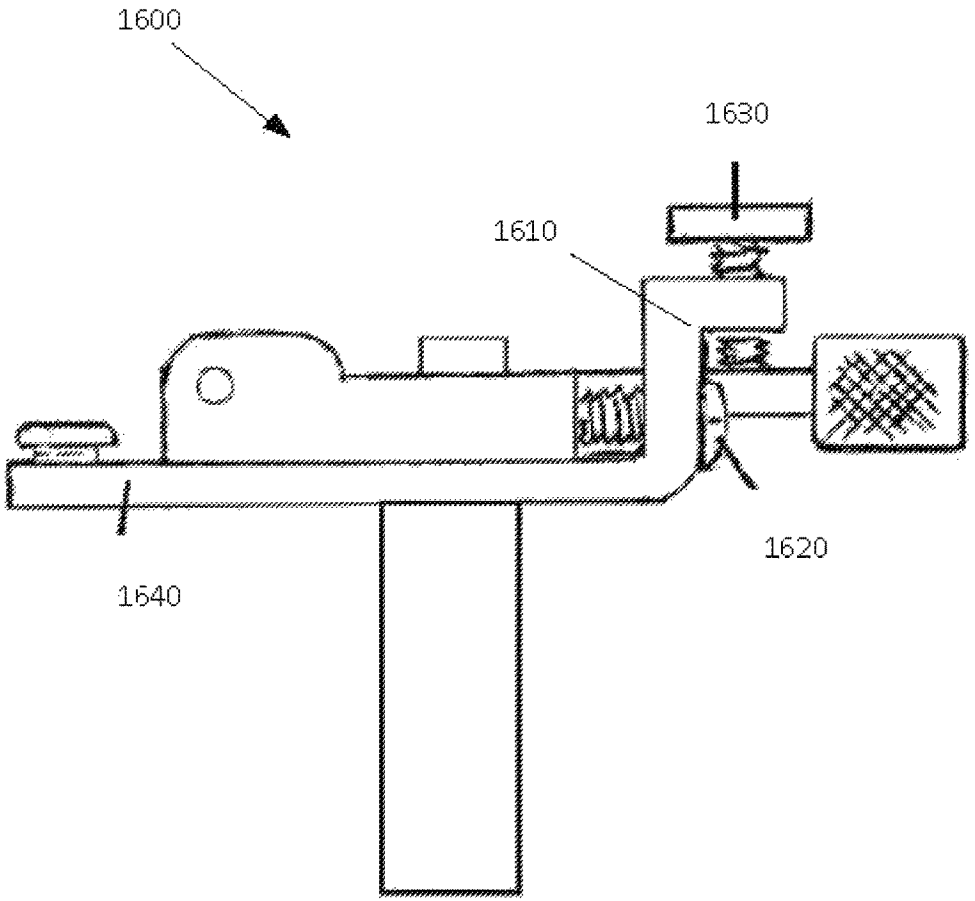

FIG. 16 depicts a side views and a top view for a replacement assembly for a keyless locking fulcrum tremolo 1600. Keyless lock 1600 may include a tremolo lock 1610 with both a circumferential string clamp, intonation screw 1620, and fine tuners 1630 inserted and threaded through baseplate 1640. Intonation clamping screws 1650 may be configured to anchor tremolo lock 1610 in place after adjustment of intonation adjustment screw 1620. Height adjustment screw 1660 may allow for individual precise adjustment of tremolo lock 1620 to match the radius of a neck of a musical instrument. This example provides a complete double locking drop in replacement to be used in conjunction with a keyless locking nut. In this case, the saddles are "split" with the side holding the string able to rotate, and the other side fixed to the baseplate 1640.

Figure 17:
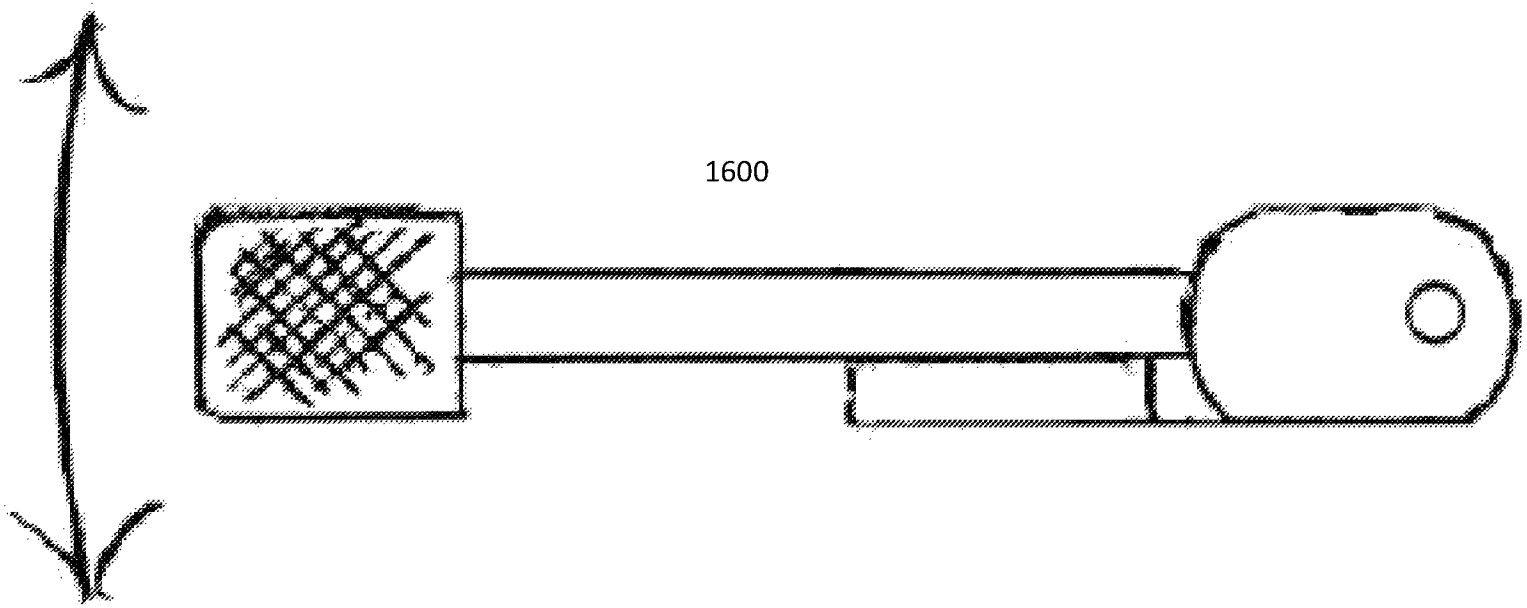
FIG. 17 depicts a side view of a keyless locking tremolo saddle, according to an embodiment.

FIG. 17 depicts a side view of a keyless locking tremolo 1600 saddle.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

I claim:

1. A string clamp for a stringed instrument comprising:
an elongated shaft comprising:
a hollow chamber extending through a length of the shaft, wherein the hollow chamber is configured to accept a string of the stringed instrument;
a first end configured to be coupled with a saddle assembly; and
a second end comprising lock closer threads; and
a lock closer having a threaded portion configured to engage the lock closer threads.

2. The string clamp of claim 1, wherein the first end comprises threads.

3. The string clamp of claim 1, further comprising:
a clamping member.

4. The string clamp of claim 3, wherein the clamping member comprises a collet configured to be inserted into and removed from the hollow chamber.

5. The string clamp of claim 3, wherein the clamping member comprises a cylindrical inner surface and a conical outer surface.

6. The string clamp of claim 1, wherein the shaft further comprises:
intonation threads.

7. The string clamp of claim 6, further comprising:
an intonation adjustment head.

8. The string clamp of claim 1, further comprising:
a saddle ramp.

9. The string clamp of claim 1, wherein the lock closer further comprises an internal cavity along an axial length of the lock closer, the internal cavity configured to allow the string to pass therethrough.

10. A string clamp for a stringed instrument comprising:

an elongated shaft comprising:

a hollow chamber extending through a length of the shaft, wherein the hollow chamber is configured to accept a string of the stringed instrument;

a first end configured to be coupled with a saddle assembly;

a second end comprising lock closer threads; and a slot extending axially along at least a portion of the length of the shaft; and a lock closer having a threaded portion configured to engage the lock closer threads.

11. The string clamp of claim 10, wherein the slot extends through at least a portion of the lock closer threads.

12. The string clamp of claim 10, wherein the first end comprises threads.

13. The string clamp of claim 10, further comprising:

a clamping member.

14. The string clamp of claim 13, wherein the clamping member comprises a collet configured to be inserted into and removed from the hollow chamber.

15. The string clamp of claim 13, wherein the clamping member comprises a cylindrical inner surface and a conical outer surface.

16. The string clamp of claim 10, wherein the shaft further comprises:

intonation threads.

17. The string clamp of claim 16, further comprising:

an intonation adjustment head.

18. The string clamp of claim 10, further comprising:

a saddle ramp.

* * * * *